US005368516A

United States Patent [19]

Hoeting et al.

[11] Patent Number: 5,368,516

[45] Date of Patent: Nov. 29, 1994

[54] RADIO CONTROLLED TWO-WHEELED TOY MOTORCYCLE

[75] Inventors: Michael G. Hoeting; Sean T. Mullaney, both of Cincinnati, Ohio

[73] Assignee: Bang Zoom Design Inc., Cincinnati, Ohio

[21] Appl. No.: 141,122

[22] Filed: Oct. 21, 1993

[51] Int. Cl.[5] ..... A63H 17/25; A63H 17/16; A63H 30/04

[52] U.S. Cl. ..... 446/288; 446/440; 446/456

[58] Field of Search ..... 446/288, 280, 279, 229, 446/228, 289, 290, 440, 454, 456, 462, 465, 466, 470

[56] References Cited

U.S. PATENT DOCUMENTS

| | | | |
|---|---|---|---|
| 3,546,814 | 12/1970 | Melendez | 446/440 X |
| 3,751,851 | 8/1973 | Nagai | 446/440 |
| 3,785,086 | 1/1974 | Escobedo | 446/440 |
| 4,290,228 | 9/1981 | Goldfarb et al. | 446/456 X |
| 4,342,175 | 8/1982 | Cernansky et al. . | |
| 4,601,674 | 7/1986 | Koizumi | 446/440 |
| 4,897,070 | 1/1990 | Wagstaff . | |
| 4,902,271 | 2/1990 | Yoneda . | |
| 4,966,569 | 10/1990 | Asano . | |

FOREIGN PATENT DOCUMENTS

| | | | |
|---|---|---|---|
| 539815 | 7/1922 | France | 446/440 |
| 616712 | 2/1927 | France | 446/440 |
| 2522275 | 9/1983 | France | 446/440 |
| 839921 | 5/1952 | Germany | 446/454 |
| 2261805 | 6/1974 | Germany | 446/440 |
| 609962 | 10/1960 | Italy | 446/440 |

OTHER PUBLICATIONS

2087740 Jun. 1982 UK Suinen.
2215626 Aug. 1989 UK Yoneda.
2227679 Aug. 1990 UK Asano.

*Primary Examiner*—Robert A. Hafer
*Assistant Examiner*—D. Neal Muir
*Attorney, Agent, or Firm*—Frost & Jacobs

[57] ABSTRACT

The motorcycle comprises a chassis which rotatively supports a rear wheel and to which a front wheel is caster mounted. A radio controlled motor is mounted in the chassis and drives the rear wheel by means of a belt drive. The chassis has a forward fairing portion which supports a shaft, the axis of which forms a forwardly directed angle with respect to the horizontal of from about 90° to about 130°. Pivotally mounted on the shaft and extending rearwardly therefrom is a swing support to which is mounted a battery pack, a radio and electronics package, a radio controlled servo and the head, arms, torso and upper leg portions of a simulated rider. The servo has a shaft operatively connected to the chassis so that it can shift the swing support to the left or right from a centered position to cause the motorcycle to turn left or right in response thereto. Lower leg assemblies for the simulated rider are provided on either side of the chassis. The lower leg assemblies are pivoted at their boot ends to foot rests extending laterally from either side of the chassis. The lower leg assemblies near their knee ends have laterally extending webs pivotally attached to the swing support. as a result, when the swing support shifts left or right to imitate a turn of the motorcycle, the knee portion of the appropriate one of the lower leg assemblies swings outwardly in the direction of the turn.

19 Claims, 7 Drawing Sheets

RADIO CONTROLLED TWO-WHEELED TOY MOTORCYCLE

TECHNICAL FIELD

The invention relates to a radio controlled motorcycle with a simulated rider, and more particularly to such a toy motorcycle having a swing support pivoted to and extending rearwardly of a shaft located near the forward end of the motorcycle, and capable of initiating a right or left turn of the motorcycle and to shift the rider and the appropriate one of his knees into the turn.

BACKGROUND ART

In recent years, there has been increased interest in toy motorcycles, and more particularly toy motorcycles which are radio controlled with respect to speed and steering.

As will be appreciated by one skilled in the art, toy motorcycles having two wheels present balance and steering problems which are more complex and far different from problems encountered with radio controlled toy four-wheeled vehicles. These problems have been approached in a number of different ways by prior art workers.

U.S. Pat. No. 4,342,175, for example, teaches a two-wheeled motorcycle having a frame or chassis which carries a drive motor, a radio, a servo mechanism, and a power source. The servo is provided with a shaft which supports a weight in the manner of an inverted pendulum. By shifting the weight to the right or left, the toy motorcycle is caused to lean to the right or left. The front wheel of the motorcycle is supported by a fork which is attached to a pivot assembly located ahead of the fork. As a consequence of this construction, when the motorcycle is caused to lean in one direction or the other by the servo mounted weight, the front wheel will turn in the direction of that lean. The motorcycle is provided with a crash bar on each side which will help to maintain the motorcycle substantially upright during a turn and when standing still.

U.S. Pat. No. 4,902,271 teaches another approach wherein a toy motorcycle is provided with a front frame supporting the front wheel and a rear frame supporting the rear wheel and a drive motor therefor. The rear frame, wheel and motor are tiltable with respect to the front frame to initiate left and right turns. Tilting of the rear frame is brought about by a servo mounted in the front frame and radio controlled. Auxiliary legs having wheels on their free ends project outwardly from both sides of the toy motorcycle, to maintain the toy motorcycle substantially upright when stopped.

U.S. Pat. No. 4,966,569 teaches a radio controlled two-wheeled motorcycle toy with yet another approach for steering the toy. The motorcycle of this reference has a horizontal, longitudinally extending shaft to which a battery pack containing frame is pivotally suspended in pendulum fashion. The front wheel of the toy motorcycle is mounted to a support mechanism comprising a fork, and a pivot member located forwardly of the fork. The battery pack is swung to the right or left in pendulum fashion by a radio controlled servo. The battery pack mechanism is operatively connected to the front wheel support, so that it tilts in the same direction as the battery pack is shifted, causing the toy motorcycle to turn in that direction. In addition, a simulated rider mounted on the toy motorcycle contains weights within its body which shift along with the shifting of the battery pack. The toy motorcycle is provided with a stand for supporting the rear wheel thereof at starting.

The present invention is directed to a radio controlled toy motorcycle which demonstrates easy steering control and remarkable stability. The toy motorcycle of the present invention is of simple and compact construction.

The toy motorcycle comprises a chassis which rotatively supports the rear wheel and to which the forward wheel is caster mounted. The chassis, near its forward end, has a shaft about which a swing support is pivoted and from which the swing support extends rearwardly. the swing support mounts a battery pack, a radio and electronics pack, a servo and a simulated rider, except for the rider's lower leg portions. The servo, being operatively connected to the chassis, shifts the swing support to the right or left from a central position, causing the toy motorcycle to lean to the right or left and therefore to turn to the right or left, the caster mounted forward wheel responding to the leaning of the motorcycle.

On each side of the motorcycle, a lower leg portion of the rider is pivotally attached to a fixed foot rest on the chassis and by a web is further pivotally affixed to the swing support. The arrangement is such that when the motorcycle toy turns to the right or left, the simulated rider and the appropriate one of his knees will shift into the turn in a realistic fashion, further stabilizing the toy motorcycle. Each knee has a reinforced touch point which will engage the surface upon which the motorcycle is running after the motorcycle has been in a turn for some time.

Finally, when the motorcycle toy is at rest following a wreck, a spin out or by virtue of simply being stopped, the motorcycle toy is capable of being started and righting itself. No manual manipulation of the motorcycle toy is required for this purpose and the motorcycle toy is free of outwardly extending legs, auxiliary wheels or other assisting devices, frequently found in the prior art.

DISCLOSURE OF THE INVENTION

According to the invention, there is provided a toy radio controlled motorcycle. The motorcycle comprises a chassis which has a forward fairing portion and a rearward bifurcated portion. The rear wheel of the toy motorcycle is rotatively supported by and between the rearward bifurcations of the chassis. The front wheel is rotatively mounted on an axle affixed to supporting portions of a fender. The fender, in turn, is affixed to a front wheel pivot shaft rotatively mounted within the front fairing portion of the chassis. The relationship between the front wheel axle and the front wheel pivot shaft is such that the front wheel is caster mounted with respect to the chassis. A radio controlled motor is mounted within the chassis and drives the rear wheel by means of a belt drive.

A second shaft is supported within the forward fairing portion of the chassis just behind the front wheel pivot shaft. The axis of this second shaft forms a forwardly directed angle of from about 90° to about 130° with the horizontal. A swing support is pivotally mounted on the second shaft and extends rearwardly therefrom. The swing support mounts a battery pack, a radio and electronics package, a radio controlled servo and the head, arms, torso and upper leg portions of a simulated rider. The servo has a rotatable shaft operatively connected by a flexible member to a pin which rides in an elongated slot in a fixed part of the chassis such that if the servo shaft rotates in a clockwise direction or in a counterclockwise direction it will shift the swing support and those elements mounted thereon from a centered position to right and left positions. When the swing support is shifted to the right or left from its centered position, the motorcycle will lean to the right or left respectively and will turn to the right or left in response thereto by virtue of the caster mounted front wheel.

Separate left and right lower leg assemblies for the simulated rider are located respectively to the left and right of the chassis. The left and right lower leg assemblies each terminate in a rearward end simulating a boot, and in a forward end simulating the rider's knee. The left and right lower leg assemblies are pivoted at their boot ends to fixed left and right foot rests extending laterally from the chassis. Each of the left and right lower leg portions near its knee end, is provided with a laterally extending flexible web, the free end of which is pivotally affixed to the adjacent side of the swing support. As a result, when the swing support shifts to the left or right to initiate a left or right turn of the toy motorcycle, the simulated rider and the knee portion of the appropriate one of the lower leg assemblies swings outwardly in the direction of the turn.

DETAILED DESCRIPTION OF THE INVENTION

Figure 1:
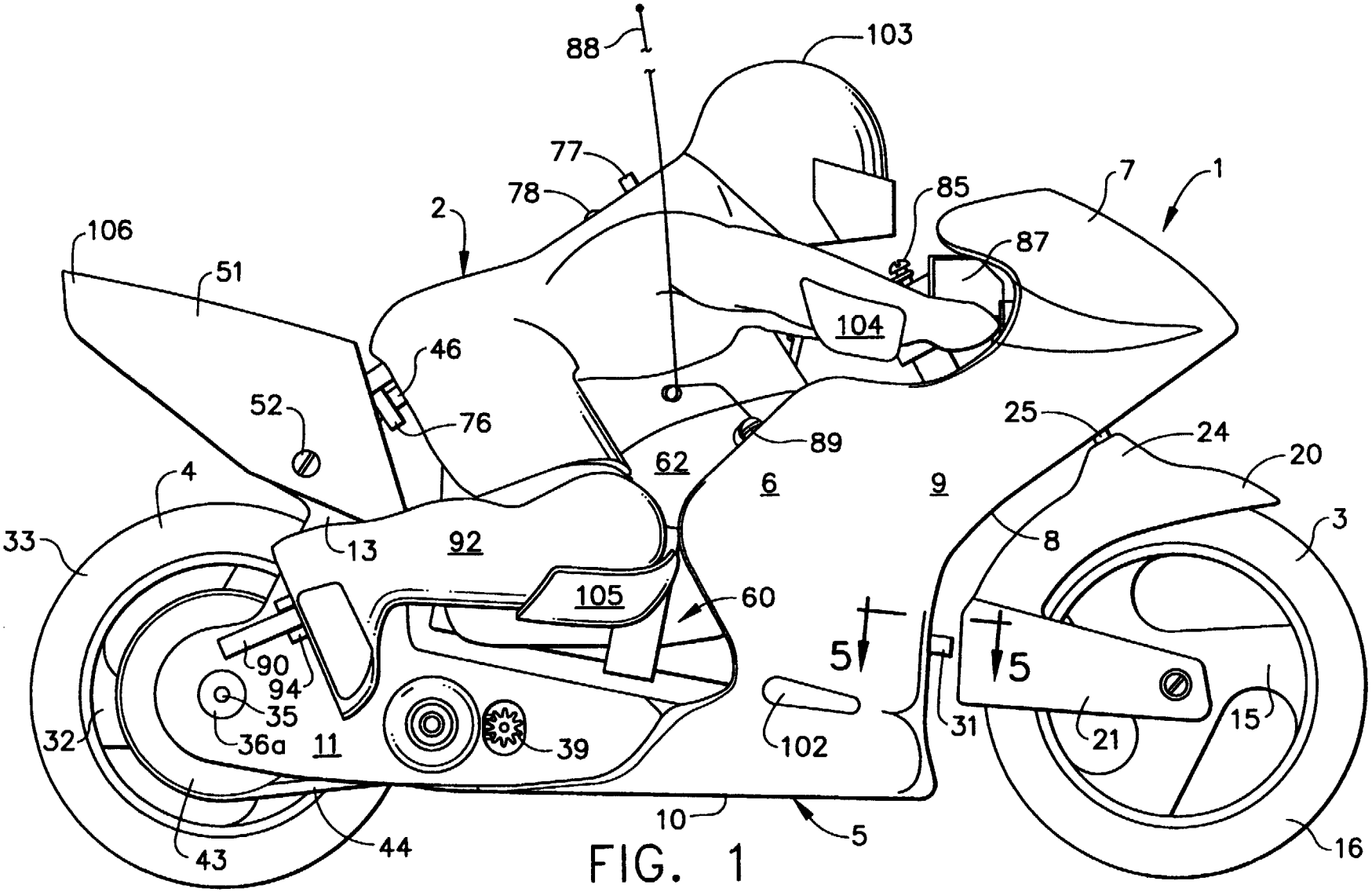
FIG. 1 is a side elevational view of the radio controlled toy motorcycle of the present invention.
Figure 2:
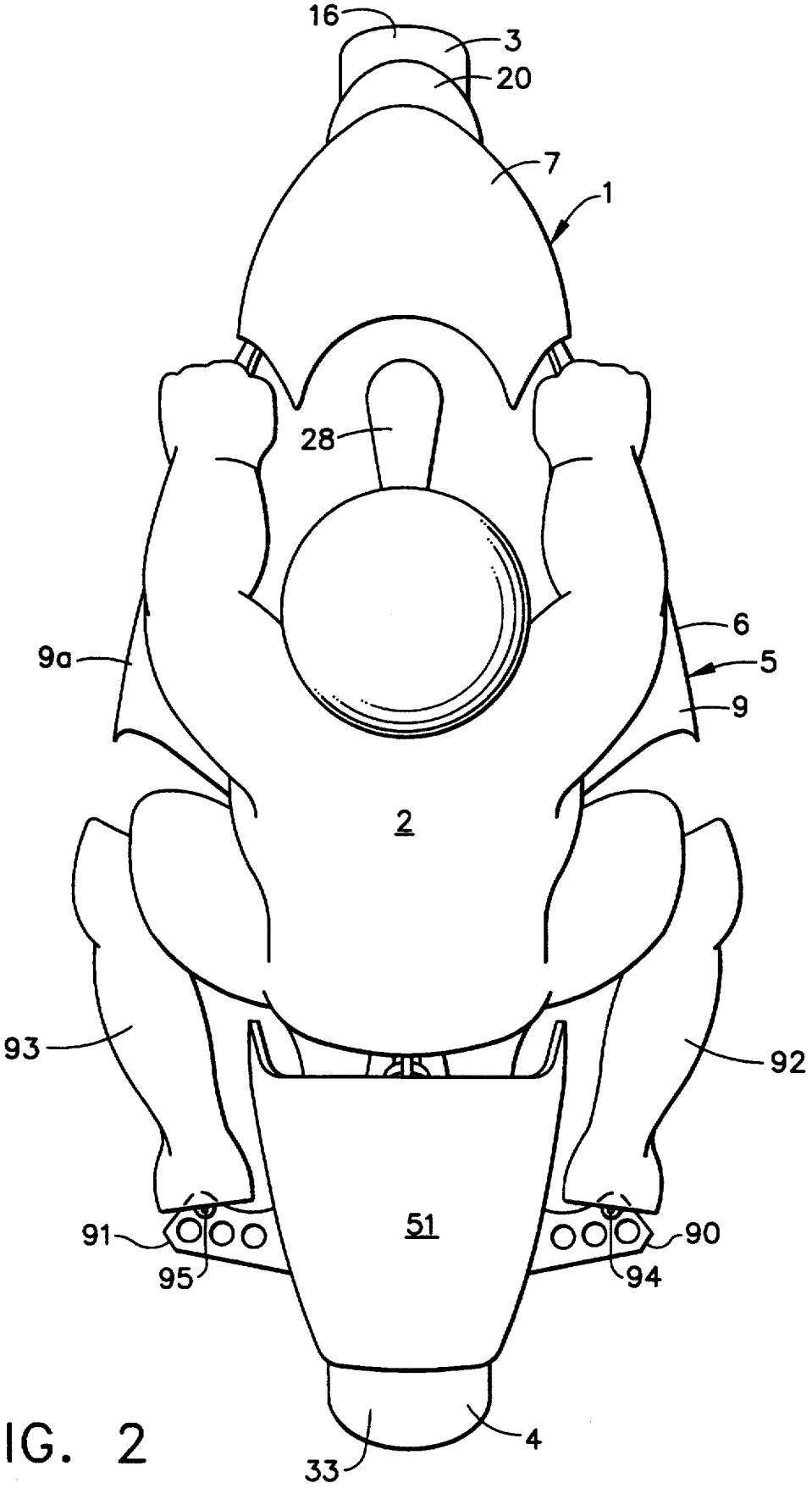
FIG. 2 is a simplified top plan view of the structure of FIG. 1.

In all of the Figures, like parts have been given like index numerals. Reference is first made to FIGS. 1–4. The toy motorcycle of the present invention is generally indicated at 1 and is provided with a simulated rider, generally indicated at 2. The motorcycle has a front wheel 3 and a rear wheel 4, operatively supported on a main frame or chassis, generally indicated at 5. The main frame 5 has a forward portion 6 which simulates a typical fairing for this type of motorcycle. The fairing portion 6 has an upper streamline portion 7 located directly in front of the driver 2. The fairing 6 has a surface 8 which slopes downwardly and rearwardly, being located above and to the rear of front wheel 3. Finally, the fairing portion has sides 9*a* and 9*b* (see FIG. 4), and a bottom 10.

The main frame or chassis 5 also has a pair of rearwardly extending bifurcations 11 and 12 which provide support for rear wheel 4, as will be apparent hereinafter. The bifurcations 11 and 12 have upstanding parts 13 and 14, respectively (again see FIG. 4).

The chassis or main frame 5 is preferably molded of a tough, resilient, plastic material such as ABS plastic, or the like. In the embodiment shown, the chassis 5 constitutes an integral, one-piece member. It would be within the scope of the invention, however, to modify this construction. For example, the chassis 5 could be made in two halves, held together by appropriate fastening means.

The front wheel 3 comprises a spoke and rim assembly 15, which may be molded of the same plastic material as chassis 5, and a resilient tire 16 of rubber or rubber-like material. It will be noted from FIG. 2 that the tire 16 is relatively wide and the surface of the tire which contacts the ground is arcuate in cross section. The spoke and rim assembly 15 is provided with a pair of laterally extending spacer hubs to either side thereof. One of the spacer hubs is shown at 17 in FIG. 3. The spacer hubs may comprise an integral, one-piece part of the spoke and rim assembly. The spacer hubs and the spoke and rim assembly 15 have a transverse bore 18 extending therethrough. The bore 18 enables the front wheel 3 to be rotatively mounted on a front axle 19.

Front wheel 3 is provided with a fender 20. At its rearmost end, the fender 20 is provided with a pair of forwardly projecting axle supports 21 and 22 (see FIGS. 1 and 3). The spacer hubs (one of which is shown at 17 in FIG. 3) of the spoke and rim assembly 15 maintain the front wheel 3 centered between the axle supports 21 and 22 of fender 20. The axle 19 is non-rotatively affixed at its ends to axle supports 21 and 22, as by threading, friction set, or the like.

Figure 3:
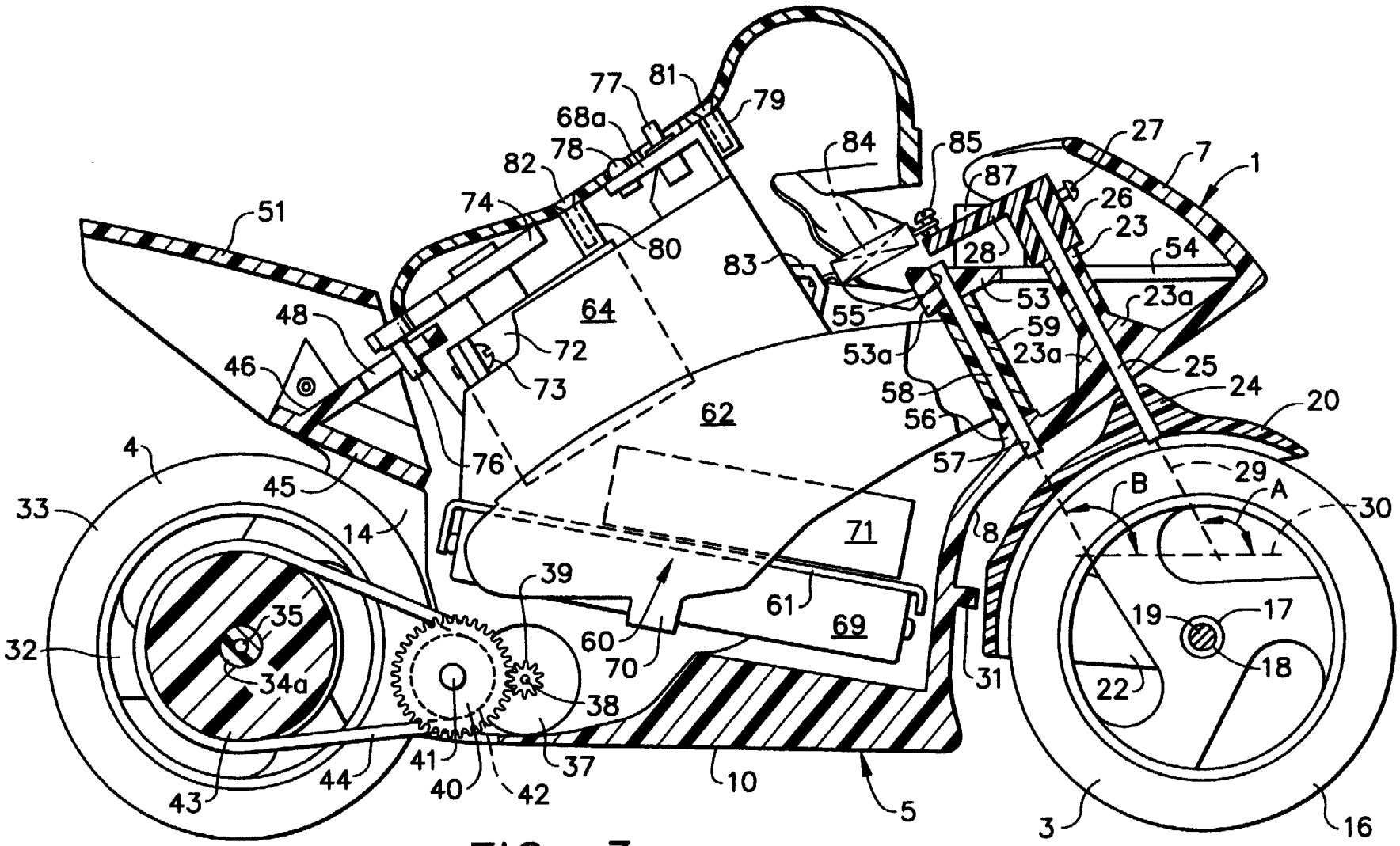
FIG. 3 is a longitudinal cross sectional view of the structure of FIG. 1.

The inside surface of the fairing portion 6 of chassis 5 is provided with a tubular shaft support 23 (see FIG. 3). Tubular shaft support 23 may constitute an integral, one-piece part of chassis 5. The tubular shaft support 23 is provided with strengthening gussets 23*a*. Fender 20 is provided with an upstanding boss 24 into which one end of the front wheel pivot shaft is non-rotatively affixed by any appropriate means such as a force fit, threading, a set screw or the like. The front wheel pivot shaft 25 extends through shaft support 23 and is rotatable therein. The upper end of the shaft 25 is non-rotatively affixed to a cap 26 by a force fit, threading, or a set screw (as shown at 27). Cap 26 prevents the shaft from slipping out of shaft support 23. The cap is provided with a laterally extending arm 28, the purpose of which will be apparent hereinafter.

An extension of the axis of front wheel pivot shaft 25 is shown in broken lines at 29. A horizontal broken line is shown at 30. The axis of front wheel pivot shaft 25 forms a forward angle A of about 115° with respect to the horizontal 30. The phrase "forward angle" as used herein and in the claims refers to an angle measured in a vertical plane incorporating the longitudinal axis of the toy motorcycle and the axis of the front wheel pivot shaft and measured with respect to the horizontal in a forward direction with respect to the motorcycle. It will further be noted that the projection 29 of the axis of the front wheel pivot shaft 25 extends forwardly of the axle 19 of front wheel 3. This results in the fact that the mount for front wheel 3 is a castor-type mount, enabling the steering of motor cycle 1, as will be apparent hereinafter.

Figure 5:
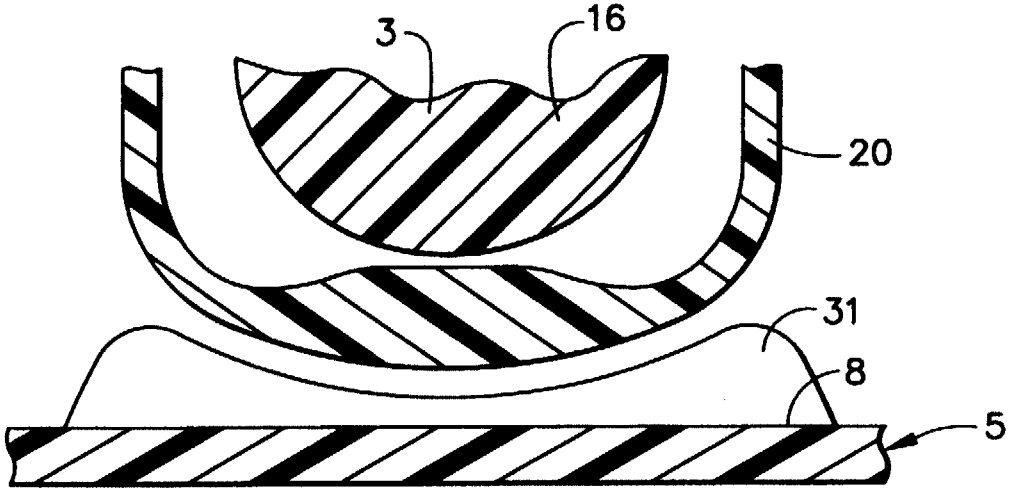
FIG. 5 is a fragmentary cross sectional view taken along section line 5—5 of FIG. 1.

Directly behind the rearwardmost part of fender 20, the surface 8 of the fairing portion 6 of the chassis 5 has a bumper 31 formed thereon (see FIGS. 1, 3 and 5). As will be apparent from FIGS. 1, 3 and 5, the rearwardmost part of fender 20 is located quite close the bumper 31. If the motorcycle 1 is inadvertently driven into an obstacle such as a vertical wall or the like, the front wheel 3 will be urged rearwardly. The fender 20 is such that a rearward force against front wheel 3 will cause the fender to bend in an area between the front wheel pivot shaft 25 and the forwardly projecting front axle supports 21 and 22. This, in turn, will cause the fender to engage the bumper 31, directing the force of impact into the chassis 5 so as to protect the front wheel pivot shaft 25 from bending or distortion.

The rear wheel 4 comprises a spoke and rim assembly 32 which may be molded of the same plastic as the main frame or chassis 5. The spoke and rim assembly 32 supports a tire 33 of rubber or rubberlike material. That peripheral surface of the tire which contacts the ground is of arcuate cross section, as can be determined from FIG. 4. It will be noted that the rear tire 33 is wider than the front tire 16 for purposes of stability and additional traction. Both the front tire 16 and the rear tire 33 are wider than their respective runs.

Figure 4:
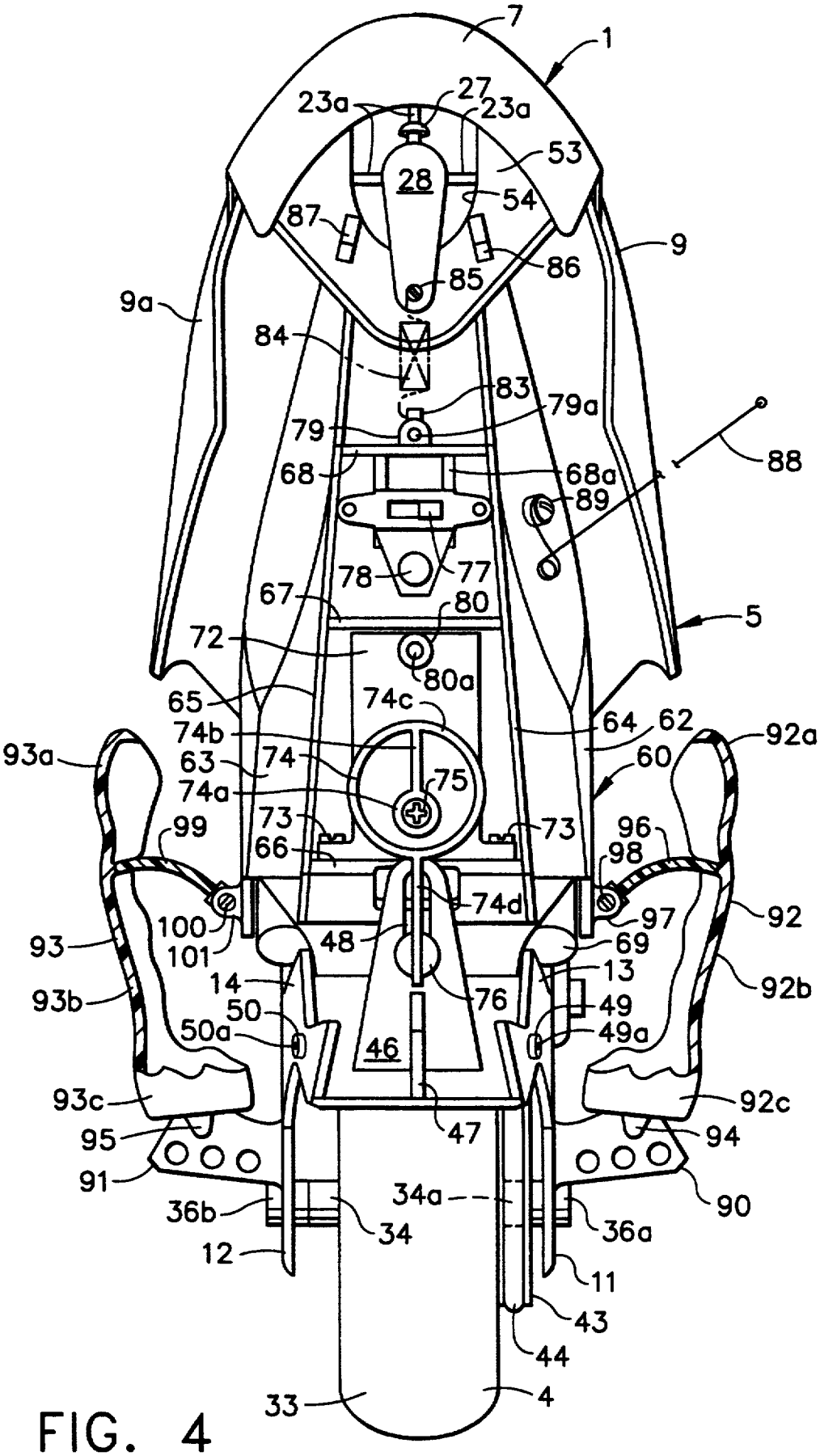
FIG. 4 illustrates the toy motorcycle with the driver's body removed, the viewing angle being perpendicular to the top surface of the servo.

The spoke and rim assembly 32 has a pair of laterally extending spacer hubs 34 and 34*a* to either side thereof (see FIG. 4). As in the case of the spoke and rim assembly 15 of front wheel 3, the hubs of the spoke and rim assembly 32 of rear wheel 4 are provided with axial bores through which a rear axle 35 extends. The rear wheel 4 and its hubs 34 and 34*a* are rotatable on the rear axle 35. The ends of the rear axle 35 are fixedly engaged in a pair of axle supports 36 and 37 which constitute a part of the bifurcations 11 and 12 of the main frame or chassis 5. The rear axle supports 36 and 37 have axial bores which receive the ends of rear axle 35. The axle ends are fixed in these bores by any appropriate means such as a friction fit, threading, or the like.

The rear wheel 4 of the motorcycle 1 is the driven wheel. To this end, a motor 37 is appropriately mounted on the inside surface of the main frame or chassis 5, at the bottom 10 thereof. The motor 37 has a drive shaft 38 to which a small pinion gear 39 is affixed. The pinion gear 39, in turn, is meshed with a larger primary gear 40 rotatively mounted on a shaft 41. The shaft 41 is non-rotatively supported at its ends by the bifurcations 11 and 12 of the chassis or main frame 5. Mounted directly behind gear 40 there is a pulley shown in broken lines at 42 in FIG. 3. Pulley 42 is affixed to gear 40 and is rotatable therewith on shaft 41. The spacing hub 34*a* of the spoke and rim assembly 32 of rear wheel 4 has a pulley 43 non-rotatively affixed thereto. The pulleys 42 and 43 are joined by a drive belt 44. Excellent results have been achieved with a pinion gear 39 having 8 teeth and a primary drive gear 40 having 43 teeth. The motor 37 drives pinion gear 39. Pinion gear 39 drives gear 40 and pulley 42. Through the agency of drive belt 44 and pulley 43, the rear wheel 4 of the motorcycle will be driven whenever motor 37 is energized.

As is best shown in FIGS. 3 and 4, the upstanding portions 13 and 14 of the main frame or chassis bifurcations 11 and 12 are joined together by a plastic plate 45 affixed thereto and therebetween by adhesive means or the like. The plastic plate 45 has a substantially triangular member 46 affixed thereto. The member 46 extends upwardly and forwardly. The member 46 may be an integral, one-piece part of plastic plate 45. Member 46 may be further supported by a gusset 47, shown in FIG. 4 only. Finally, member 46 has an elongated slot 48 formed therein. The purpose of the substantially triangular member 46 and its elongated slot 48 will be described hereinafter.

The upstanding portions 13 and 14 of the chassis bifurcations 11 and 12 are provided with bosses 49 and 50, respectively. The bosses 49 and 50 contain threaded bores 49*a* and 50*a*, respectively. The threaded bores 49*a* and 50*a* are adapted to receive screws by which the rear fender 51 is affixed to the chassis. One such screw is shown at 52 in FIG. 1. The gusset member 47, shown only in FIG. 4, may be so configured as to contact the inside surface of rear fender 51, stabilizing the position thereof.

Inside the upper part of the fairing portion 6 of chassis 5 there is located a substantially horizontal platform 53 (see FIGS. 3 and 4). The platform 53 may be an integral, one-piece part of the chassis 5, or it may be a separate member adhesively fixed in place. The forward part of platform 53 has an opening 54 formed therein, through which the front wheel pivot shaft support 23, the cap 26 and the arm 28 extend. The rearmost portion of platform 53 is of increased thickness, as at 53*a*. The portion 53*a* has a bore 55 formed therein. The inside surface of the wall portion 8 of the fairing part 6 of chassis 5 is provided with an upstanding boss 56 having a bore 57 formed therein. The bores 55 and 57 receive the ends of a shaft 58. The ends of shaft 58 are non-rotatively affixed in bores 55 and 57 by means of a force fit, a threaded engagement, or other appropriate expedients. It will be noted that the shaft 58 is substantially parallel to the front wheel pivot shaft 25, and forms a forward angle B about 115° with the horizontal. The "forward angle" is measured in a vertical plan incorporating the longitudinal axis of the toy motorcycle and the axis of shaft 58, and is measured with respect to the horizontal and forwardly with respect to the motorcycle, as in the case of angle A.

Pivotally mounted about shaft 58 is the forward end 59 of a swing support, generally indicated at 60. The swing support 60 has a bottom 61 and a pair of sides 62 and 63. The sides 62 and 63 have upward extension 64 and 65, respectively. The upward extensions 64 and 65 are joined together by transverse walls 66, 67 and 68. The bottom 61 and sides 62 and 63 of swing support 60 are so configured as to releasably support a battery pack 69 beneath the swing support bottom 61 and between sides 62 and 63, the sides 62 and 63 having integral, straplike retainer fingers, one of which is shown at 70 in FIG. 3. While not intended to be so limited, excellent results have been achieved using a 9.6 volt battery pack manufactured by Tyco Company of Mt. Laurel, N.J., under the designation No. 2998.

Fixed to the upper side of the swing support bottom 61 there is a radio and electronics package 71. The radio and electronics package 71 is a conventional two-channel package as is well known in the art. Excellent results have been achieved, for example, utilizing the radio and electronics package manufactured by Tyco Company of Mt. Laurel, N.J., under the designation TY-V2050-J. A conventional servo 72 is located between side extensions 64 and 65 and transverse partitions 66 and 67. The servo, for example, may be affixed to transverse partition 66 by screws 73. Servo 72 has a shaft (not shown) to which a flexible connector 74 is attached. Flexible connector 74 comprises a sleeve 74*a* affixed about the servo shaft by a screw 75. The sleeve 74 has a laterally extending arm 74*b* connected to the inside surface of a ring portion 74*c*. The ring portion 74*c* has a laterally extending exterior arm 74*d* which is operatively connected to a pin 76, which extends within the elongated slot 48 of the substantially triangular member 46. The flexible connector 74 may constitute an integral, one-piece structure, molded of resilient plastic or the like.

Flexible connector 74 acts as a flexible link between the servo shaft and substantially triangular member 46 and protects the internal gearing of servo 72. The purpose and operation of the servo 72 will be set forth hereinafter.

The forwardmost transverse wall 68 of swing support 60 has a upwardly and rearwardly extending support portion 68*a*, either affixed thereto, or constituting an integral, one-piece part thereof. This upwardly and rearwardly extending portion 68*a* is best seen in FIGS. 3 and 4, and serves as a support for a power switch (connecting the radio and electronics pack 71 and servo 72 to battery pack 69), and a "power on" indicator LED. Mounted on support 68*a* there is a first rider mounting boss 79 having a threaded bore 79*a*. Affixed to the upper side of servo 72, there is a second rider mounting boss 80, having a threaded bore 80*a*. These bosses enable the body of the simulated rider 2 to be removably affixed to swing support 60 by screws 81 and 82. The body of the rider 2, so mounted, comprises the rider's head, torso, arms and hands, and upper legs down to the knees, all of which constitute an integral, one-piece plastic molding. The rider's knees, lower legs and feet constitute separate elements as will be described hereinafter.

The forward surface of transverse wall 68 is provided with a loop 83 (see FIGS. 3 and 4) to which one end of a tension spring 84 is attached. The other end of tension spring 84 is affixed to a set screw 85 mounted at the free end of arm 28. The tension spring 84 is not strong enough to interfere with the steering of the castor mounted front wheel 3. Tension spring 84 does, however, serve to dampen any tendency of front wheel 3 to wobble. The maximum amount by which front wheel 3 can turn to the left or to the right is determined by a pair of stops 86 and 87 affixed to the upper side of platform 53 in such a manner as to be abuttable by arm 28. As is shown in FIGS. 1 and 4, an antenna 88 is provided for the radio and electronics pack 71. The antenna may be mounted in any appropriate place on the motorcycle assembly. For purposes of an exemplary showing, antenna 8 is illustrated as being affixed to the side 62 of swing support 60 by a screw 89.

The right and left bifurcations 11 and 12 of chassis 5 are provided with laterally extending footrests 90 and 91, respectively. As is shown in FIGS. 1, 2, 4, 6 and 7, right and left lower leg assemblies 92 and 93 are provided. The lower leg assembly 92 comprises a knee portion 92*a*, a lower leg portion 92*b* and a foot or boot portion 92*c*. The lower leg assembly 93 is a mirror image of lower leg assembly 92 and comprises a knee portion 93*a*, a lower leg portion 93*b*, and a foot or boot portion 93*c*. The boot portions 92*c* and 93*c* are pivotally attached to the adjacent one of footrests 90 and 91, respectively. Preferably, this pivotal attachment is releasable. In an exemplary attachment, the boot portions 92*c* and 93*c* are provided with pivot pin elements 94 and 95, respectively, which engage in notches (not shown) in footrests 90 and 91 with a snap fit. The footrests 90 and 91 and the pivot pin elements 94 and 95 are so oriented that the pivot pin elements 94 and 95 are substantially parallel to shaft 58 about which swing support 60 is pivoted.

Lower leg assembly 92, near the juncture of knee portion 92*a* and lower leg portion 92*b* is provided with a laterally extending flexible web 96 pivotally attached to a pivot lug 97 on side 62 of swing support 60, as at 98. While web 96 may be a separate flexible element glued to lower leg assembly 92, it may also constitute an integral, one-piece part of lower leg assembly 92. In a similar fashion, lower leg assembly 93 is provided with a web 99, equivalent to web 96 and pivotally attached as at 100 to a pivot lug 101 on the side 63 of swing support 60. The pivots 98 and 100 are also substantially parallel to pivot shaft 58.

As will be appreciated by one skilled in the art, the motorcycle assembly just described will be used in conjunction with a hand held controller (not shown), as is well known in the art. The controller per se, is conventional and does not constitute a part of this invention. The controller will constitute a two channel controller, a first channel operating motor 37 of the motorcycle assembly and a second channel operating servo 72 of the motorcycle assembly. With respect to the first channel for activating motor 37, the controller may be of the type actuating motor 37 at a single speed, at a variable speed, or at two or more stepped speeds. The control of the controller for the second channel is of the digital type which, when actuated in one direction causes the servo shaft to rotate to its maximum clockwise position, and when actuated in the opposite direction, will cause the servo shaft to rotate to its maximum counterclockwise position. When the second channel control is released to its normal position, the servo shaft will be driven to its normal unactuated position. Excellent results have been achieved utilizing a hand held two channel controller. The controller may be of the type having a first channel control in the form of a trigger providing two stepped speeds, and a knob rotatable in clockwise and counterclockwise directions for the second channel actuating servo 72. As will be understood by one skilled in the art, a proportional channel could also be used.

Toy motorcycle 1 has a series of primary contact points which may contact the surface upon which the motorcycle runs, when the motorcycle wrecks, or is at rest. Referring specifically to FIG. 1, a lower contact point is indicated at 102, located on the fairing portion 6 of chassis 5. A top contact point 103 constitutes the upper part of the rider's helmet. An elbow contact point is shown at 104 and a knee contact point is shown at 105. Finally, a rear contact point is indicated at 106 at the rearwardmost portion of rear fender 51. It will be understood by one skilled in the art that a similar set of primary contact points exists on the opposite side of toy motorcycle 1. Some of the contact points such as lower contact point 102, elbow contact point 104 and knee contact point 105 may have an added thickness or layer of plastic to absorb wear.

The toy motorcycle 1 of the present invention having been described in detail, its mode of operation can now be set forth. When the motorcycle is properly placed upon the ground and is sitting still, with the servo unactuated, the toy motorcycle 1 will rest upon front and rear wheels 3 and 4 and lower contact point 102. Since lower contact point 102 is closer to the front wheel 3 than to the rear wheel 4, more weight rests upon the rear wheel for added traction when the motor 37 is energized. As the rear wheel 4 starts turning, the vehicle will begin to rotate about lower contact point 102. The vehicle will normally lift itself off lower contact point 102 and onto its two wheels only within a 360° rotation about lower contact point 102. Thus, the toy motorcycle 1 can be self-starting and self-righting. The entire start-up action creates a "spin out" visual impression, as the motorcycle 1 accelerates from a standstill.

With the servo 72 unactuated swing support 60 (together with the battery pack, the radio/electronics package 71, the servo 72 and the rider 2) will be centered with respect to chassis 5. The result of this will be that the toy motorcycle 1 moves forwardly in a substantially straight line, with the various elements oriented in the manner shown in FIG. 2.

Figure 6:
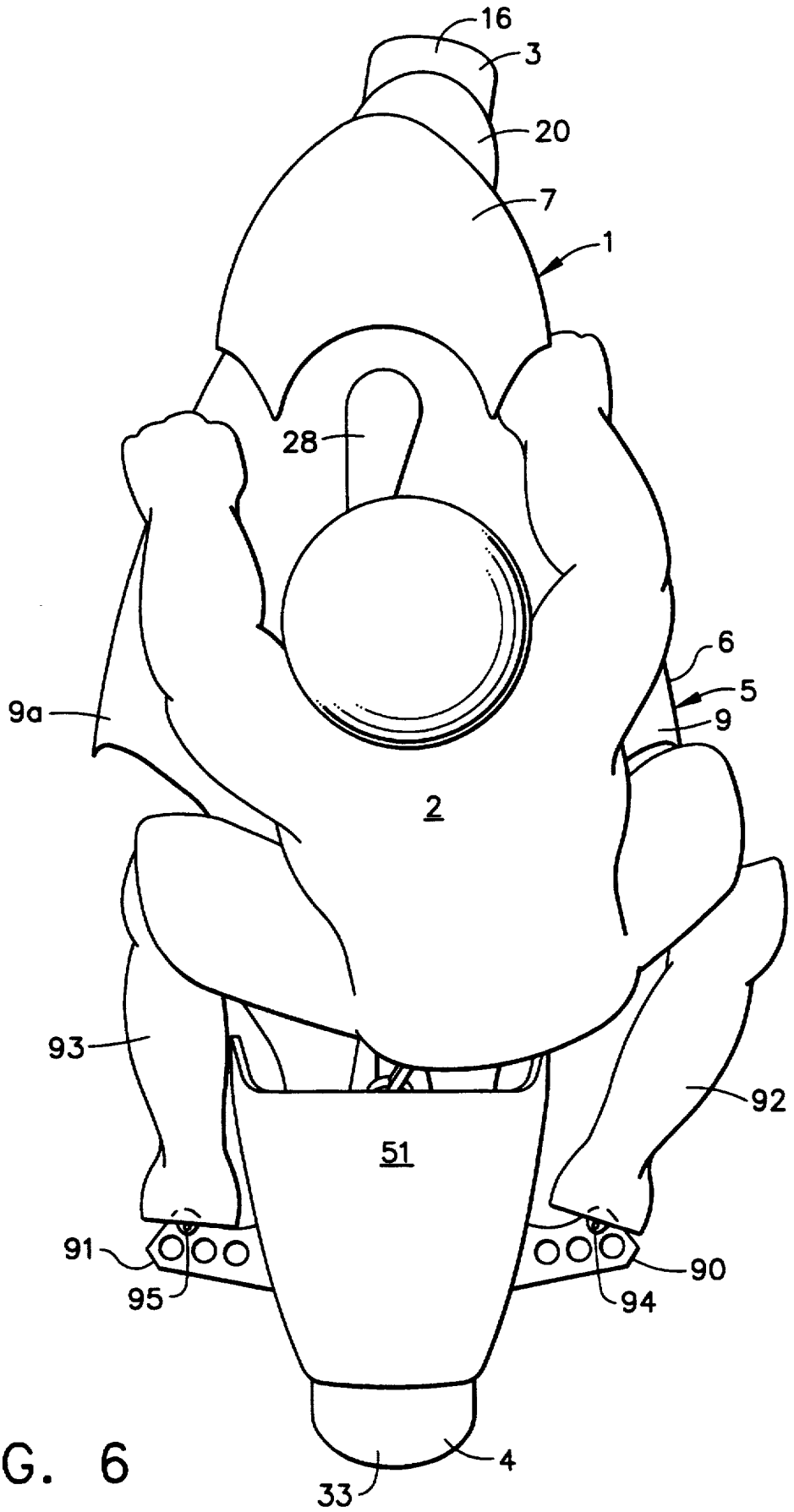
FIGS. 6 and 7 are simplified top plan views illustrating the structure of FIG. 2 is right and left turn modes, respectively.
Figure 7:
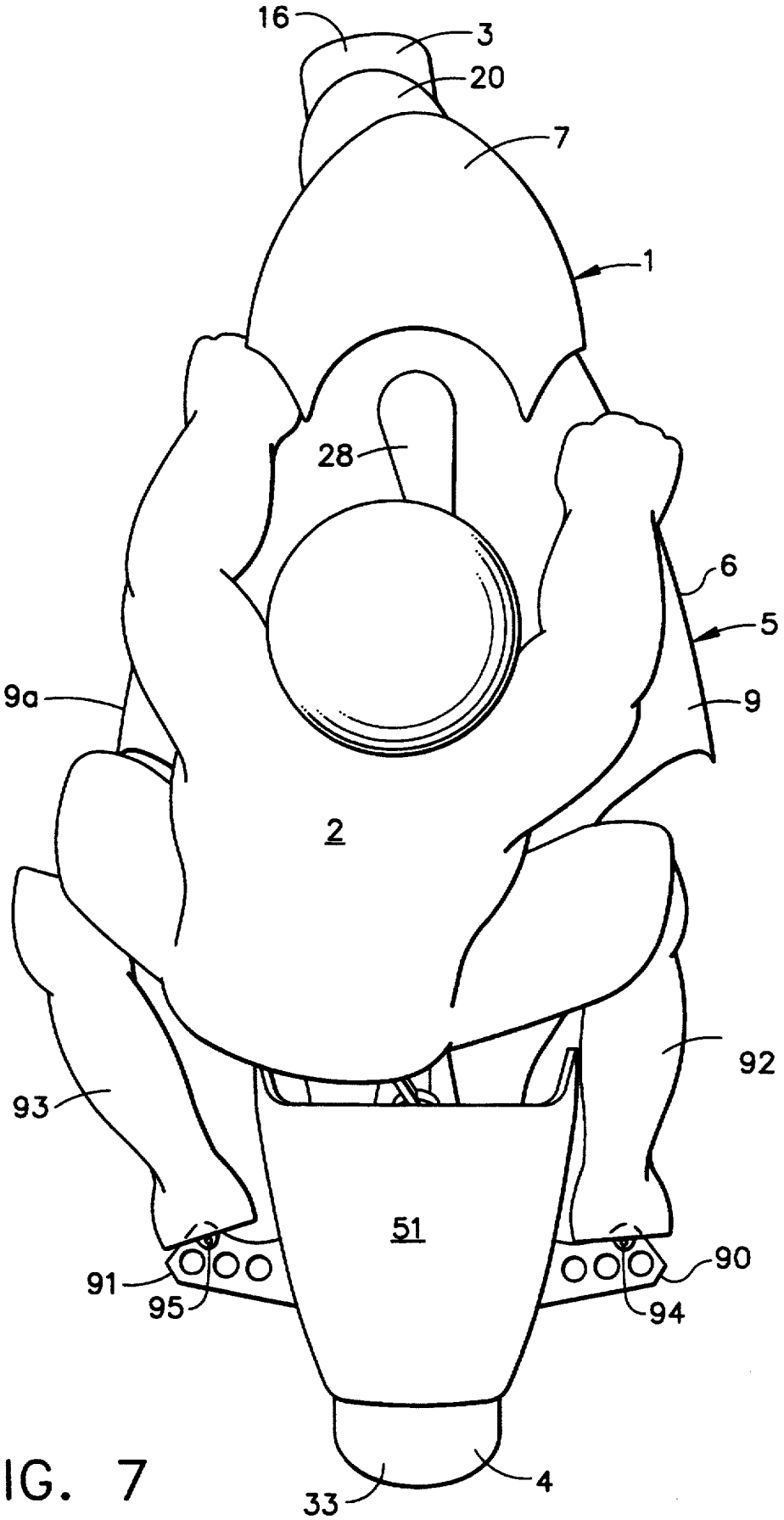

Turning to FIG. 4, if the shaft of servo 72 is caused to turn to its maximum clockwise position by actuation of the hand held controller (not shown), the swing support 60 (and all that it carries including rider 2) will shift to the right. This shift of swing support 60 results in a weight shift which causes the chassis 5 of toy motorcycle 1 to lean to the right. The caster mounted front wheel 3 follows, also shifting to the right and causing the toy motorcycle to turn to the right, as shown in FIG. 6. The right lower leg portion, being pivotally attached to swing support 60 at 98, will pivot at 94 with respect to footrest 90, causing the rider's right knee to shift outwardly to the right. The right knee contact point 105 (see FIG. 1) now extends further to the right than the lower contact point 102. The toy motorcycle 1 will continue to lean to the right and to turn to the right until the knee contact point 105 touches the surface upon which the motorcycle is running. Once the knee contact point 105 makes contact with the supporting surface, the motorcycle will maintain the turn until the rider 2 and the swing support 60 are returned to their center position (shown in FIGS. 2 and 4), whereupon the motorcycle will move forward in a straight line. A left turn is initiated by actuating the hand held controller (not shown) so as to cause the shaft of servo 72 to turn to its maximum counterclockwise position. This, in the same manner described heretofore, will cause swing support 60 and all that is mounted thereon to shift to the left, including the lower leg portion 93. Caster mounted front wheel 3 will follow, turning to the left and causing the toy motorcycle 1 to turn to the left, as shown in FIG. 7. Again, the toy motorcycle 1 will continue to lean until the contact point (not shown) on lower leg portion 93 touches the surface upon which the toy motorcycle 1 is running. The toy motorcycle will continue executing this turn, until the swing support 60, rider 2 and the lower leg portion 93 return to their normal centered positions, shown in FIG. 2.

Whichever way the toy motorcycle leans, the front wheel will follow and turn in that same direction by virtue of the fact that it is caster mounted. It will be remembered that the tension spring 84 will dampen any tendency of front wheel 3 to wobble, and the amount by which the front wheel turns either to the left or the right will be determined by stops 86 and 87 cooperating with arm 28 (see FIG. 4).

The toy motorcycle 1 of the present invention is of less scale height than a full size Moto Grand Prix motorcycle. The tires 16 and 33 are wider than scale, with the rear tire 33 being wider than front tire 16. These small deviations from scale greatly increase the stability of toy motorcycle 1.

It has been noted above that the toy motorcycle 1 can start itself from a fully stopped position wherein it is resting on its tires 16 and 33 and one of its lower contact points (one of which is shown at 102 in FIG. 1). If the toy motorcycle 1 is located on its side in such a way that one or both of tires 16 and 33 are not touching the supporting surface (by virtue of being improperly placed on the supporting surface or as the result of a spin out or wreck), this situation can be rectified without touching the toy motorcycle 1. It is only necessary to energize servo 72 (by means of the hand held controller—not shown), so that that lower leg portion 92 or 93 of the rider, adjacent the supporting surface is shifted outwardly. This will result in a positioning of toy motorcycle 1 such that it rests upon tires 16 and 33 and the appropriate one of the lower contact points, a position from which toy motorcycle 1 can start itself.

The shaft 58 upon which the swing support 60 is pivoted has been described as being parallel to shaft 25 and thus forming with the horizontal 30 a forward angle B equal to forward angle A, i.e. about 115°. While forward angle B could range from about 90° to about 130°, an angle of about 115° is preferred. The slight inclination shaft 58 causes the swing support 60 to shift slightly upwardly as it reaches its maximum left or right swing. This provides more clearance of the swing support 60 within chassis 5 and allows for a greater amount of swing in either direction. It also assists in returning the swing support to its centered position.

The swing of the rider 2 during a turn, and the extension of the appropriate one of his knees in the direction of a turn, greatly enhances the realism of toy motorcycle 1.

Modifications may be made in the invention without departing from the spirit of it.

What is claimed is:

1. A toy two-wheeled motorcycle comprising a chassis having a front fairing portion and a rearward portion, a rear wheel being supported by said rearward chassis portion, a radio controlled motor mounted in said chassis and drivingly connected to said rear wheel, a front wheel caster mounted to said chassis front fairing portion, a first shaft non-horizontally mounted in said chassis front fairing portion, a swing support having forward and rearward ends, said swing support forward end being pivoted about said first shaft with the remainder of said swing support extending rearwardly thereof, said toy motorcycle further comprising a battery pack, a radio and electronics package and a radio controlled servo, said servo being operatively connected to said chassis and said swing support, said swing support being shiftable by said servo about said first shaft from a normal position centered with respect to said chassis to extended left and right positions, whereby to cause said chassis to lean to the left or right respectively and to cause said caster mounted front wheel to turn said toy motorcycle in the direction of the lean to the left or right respectively.

2. The toy motorcycle claimed in claim 1 wherein said first shaft forms a forward angle with the horizontal of from about 90° to about 130°.

3. The toy motorcycle claimed in claim 1 wherein said first shaft forms a forward angle with the horizontal of about 115°.

4. The toy motorcycle claimed in claim 1 including a fender for said front wheel said fender having a rearward end from which a pair of axle supports extend forwardly, said front wheel being rotatively mounted on an axle located between and affixed to said supports, a front wheel pivot shaft being rotatively mounted in said fairing portion of said chassis and having a lower end non-rotatively affixed to said fender, said front wheel pivot shaft having a longitudinal axis, an imaginary extension of said axis passing forwardly of said front wheel axle, said front wheel pivot shaft being located forwardly of said first shaft within said fairing portion of said chassis.

5. The toy motorcycle claimed in claim 1 including a simulated rider affixed to and swingable with said swing support.

6. The toy motorcycle claimed in claim 4 wherein said front wheel pivot shaft forms a forward angle of about 115° with the horizontal.

7. The toy motorcycle claimed in claim 4 wherein said front wheel pivot shaft has an upper end, an arm affixed to said front wheel pivot shaft upper end and extending rearwardly with respect to said toy motorcycle, said arm having a free end, a tension spring affixed at one end to said free end of arm and affixed at its other end to said swing support, said tension spring comprising a dampener for wobble of said front wheel.

8. The motorcycle claimed in claim 4 including a horizontal bumper on said front fairing portion of said chassis closely spaced from said fender rearward end, whereby an impact force on said front wheel will be transferred to said chassis by abuttment of said fender rear portion against said bumper.

9. The toy motorcycle claimed in claim 1 including a simulated rider affixed to said swing support and shiftable therewith, said simulated rider comprising a helmet, a torso, arms and hands, and upper leg portions terminating just short of the knees, separate left and right lower leg assemblies for said simulated rider being located respectively to the left and right of said chassis, said left and right lower leg assemblies each terminating in a rearward end simulating a boot and in a forward end simulating the rider's knee, fixed left and right foot rests extending laterally from said chassis, said left and right lower leg assemblies at their boot ends being pivotally affixed to said left and right foot rests respectively, a laterally extending flexible web being affixed to each of said left and right lower leg assemblies near said knee end thereof, each of said flexible webs having a free end pivotally affixed to the adjacent side of said swing support, whereby when said swing support shifts to the left or right to initiate a left or right turn of said toy motorcycle, said simulated rider and said knee end of the appropriate one of said lower leg assemblies swings outwardly in the direction of the turn.

10. The toy motorcycle claimed in claim 6 wherein said first shaft forms a forward angle with the horizontal of from about 90° to about 130°.

11. The toy motorcycle claimed in claim 6 wherein said first shaft forms a forward angle with the horizontal of about 115°.

12. The toy motorcycle claimed in claim 6 including a fender for said front wheel said fender having a rearward end from which a pair of axle supports extend forwardly, said front wheel being rotatively mounted on an axle located between and affixed to said supports, a front wheel pivot shaft being rotatively mounted in said fairing portion of said chassis and having a lower end non-rotatively affixed to said fender, said front wheel pivot shaft having a longitudinal axis, an imaginary extension of said axis passing forwardly of said front wheel axle, said front wheel pivot shaft being located forwardly of said first shaft within said fairing portion of said chassis.

13. The toy motorcycle claimed in claim 12 wherein said front wheel pivot shaft forms a forward angle of about 115° with the horizontal.

14. The toy motorcycle claimed in claim 13 wherein said first shaft forms a forward angle with the horizontal of about 115°.

15. The toy motorcycle claimed in claim 1 including a supporting surface for said toy motorcycle to run upon, said front cowling portion of said chassis having a left side contact point and a right side contact point, said toy motorcycle having two at rest positions in which said toy motorcycle is supported on said surface by said front wheel, said rear wheel, and one of said contact points, said contact points being closer to said front wheel than said rear wheel, said rear wheel bearing more weight than said front wheel in either of said at rest positions, whereby driving of said rear wheel by said motor in either of said at rest positions will cause said toy motorcycle to right itself and run along said surface from either of said at rest positions.

16. The toy motorcycle claimed in claim 15 wherein said toy motorcycle has a center of gravity so positioned as to cause said toy motorcycle when not running to automatically assume one of said at rest positions when said supporting surface is horizontal.

17. The toy motorcycle claimed in claim 1 wherein said rearward chassis portion is bifurcated, said rear wheel having an axle, said axle being supported between said bifurcations.

18. The toy motorcycle claimed in claim 1 wherein said battery pack, said radio and electronics package and said radio controlled servo are mounted on said swing support.

19. The toy motorcycle claimed in claim 18 wherein said servo has a shaft connected to said chassis by linkage means for shifting said swing support about said first shaft from said normal position to said extended left and right positions depending upon the direction of rotation of said servo shaft.

* * * * *

UNITED STATES PATENT AND TRADEMARK OFFICE

CERTIFICATE OF CORRECTION

PATENT NO. : 5,368,516

DATED : November 29, 1994

INVENTOR(S) : Michael G. Hoeting & Sean T. Mullaney

It is certified that error appears in the above-indentified patent and that said Letters Patent is hereby corrected as shown below:

In column 11, line 43, (claim 10), "6" should read "9"

In column 11, line 46, (claim 11), "6" should read "9"

In column 11, line 49, (claim 12), "6" should read "9"

Signed and Sealed this

Fourteenth Day of March, 1995

*Attest:*

*Attesting Officer*

BRUCE LEHMAN

*Commissioner of Patents and Trademarks*